US011742594B2

(12) United States Patent
Xue et al.

(10) Patent No.: US 11,742,594 B2
(45) Date of Patent: Aug. 29, 2023

(54) LOW-PROFILE CIRCULARLY POLARIZED ISOFLUX ANTENNA MODULE

(71) Applicant: SOUTH CHINA UNIVERSITY OF TECHNOLOGY, Guangdong (CN)

(72) Inventors: Quan Xue, Guangdong (CN); Wenquan Che, Guangdong (CN); Siyu Li, Guangdong (CN); Shaowei Liao, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 108 days.

(21) Appl. No.: 17/569,503

(22) Filed: Jan. 6, 2022

(65) Prior Publication Data

US 2022/0239015 A1 Jul. 28, 2022

(30) Foreign Application Priority Data

Jan. 26, 2021 (CN) ..... 202110105038.5

(51) Int. Cl.
*H01Q 21/24* (2006.01)
*H01Q 9/04* (2006.01)

(52) U.S. Cl.
CPC ..... *H01Q 21/24* (2013.01); *H01Q 9/0421* (2013.01)

(58) Field of Classification Search
CPC ..... H01Q 21/24; H01Q 9/0421
See application file for complete search history.

(56) References Cited

FOREIGN PATENT DOCUMENTS

| | | | |
|---|---|---|---|
| CN | 102931479 A | * | 2/2013 |
| CN | 105762534 | | 7/2016 |
| CN | 106450738 | | 2/2017 |
| CN | 108232432 | | 6/2018 |
| CN | 109755765 | | 5/2019 |
| CN | 110277647 | | 9/2019 |
| CN | 209515989 | | 10/2019 |
| CN | 209515990 | | 10/2019 |

(Continued)

OTHER PUBLICATIONS

Siyu Li et al., "A Low-Profile Sequential Rotation-Fed Circularly Polarized Annular Aperture Antenna Array for Earth Coverage Applications," 2020 IEEE MTT-S International Wireless Symposium (IWS), Sep. 2020, pp. 1-3.

(Continued)

*Primary Examiner* — Dieu Hien T Duong
(74) *Attorney, Agent, or Firm* — JCIP GLOBAL INC.

(57) ABSTRACT

A low-profile circularly polarized isoflux antenna module is provided, which relates to the field of microelectronic antennas, and provides a solution to solve the contradiction between size and gain in conventional technology. The antenna module includes an antenna array, a substrate, a connection plate, and a feeding plate that are stacked in sequence. The feeding network on the feeding plate is electrically connected to the antenna array through probe passing through the connection plate and the substrate. The antenna array includes two or more concentrically distributed antenna elements, and each antenna element forms mutually independent concentric circularly polarized apertures through feed control. The structure is simple to assemble and easy to process, light in weight, small in size, and low in profile.

6 Claims, 7 Drawing Sheets

(56) References Cited

FOREIGN PATENT DOCUMENTS

CN 111082202 4/2020

OTHER PUBLICATIONS

Jamil Fouany et al., "New Concept of Telemetry X-Band Circularly Polarized Antenna Payload for CubeSat," IEEE Antennas and Wireless Propagation Letters, Sep. 2017, pp. 1-5.
Xue Ren et al., "A Circularly Polarized Spaceborne Antenna With Shaped Beam for Earth Coverage Applications," IEEE Transactions on Antennas and Propagation, vol. 67, Apr. 2019, pp. 2235-2242.
"Office Action of China Counterpart Application", dated Jul. 22, 2021, p. 1-p. 7.

* cited by examiner

LOW-PROFILE CIRCULARLY POLARIZED ISOFLUX ANTENNA MODULE

CROSS-REFERENCE TO RELATED APPLICATION

This application claims the priority benefit of China application serial no. 202110105038.5, filed on Jan. 26, 2021. The entirety of the above-mentioned patent application is hereby incorporated by reference herein and made a part of this specification.

BACKGROUND

Field of the Disclosure

The disclosure relates to the field of microelectronic antennas, in particular to a low-profile circularly polarized isoflux antenna module.

Description of Related Art

Compared with expensive large satellites, small satellites have the advantages of low manufacturing cost and short development cycle. The investment of launching a large satellite can be used to launch multiple small satellites. Therefore, small satellites have received considerable attention in various fields in recent years. Among all small satellites, CubeSat has been widely adopted in the field of low-orbit satellites due to its advantages of light weight, easy integration, and modularization. One unit of the CubeSat has a cube volume of 10 cm×10 cm×10 cm and is called 1 U. Multiple units can be combined into an nU satellite, up to 24 units can be combined, and the structure is flexible and convenient for application. However, due to its limited size, how to integrate RF (Radio frequency) devices that meet the performance requirements on the limited surface of the CubeSat is an important issue for further research.

As an important front-end component of the RF system, the antenna must have different characteristics in different fields. Specifically, circular polarization is favored by the majority of researchers because of its ability to suppress multipath effects and polarization mismatch. In addition, because the earth is circular, if the satellite signal is required to cover a specific area on the surface of the earth, it is desired that the antenna used by the satellite can produce an isoflux pattern, so that the same intensity electric field distribution can be obtained in the coverage area, that is, substantially the same signal strength. Moreover, because antenna structure is integrated on a smaller CubeSat, it is also desired that the antenna can be as light as possible, have a low profile, and have a certain structural strength.

In currently available solutions, J. Fouany et al., "New concept of telemetry X-band circularly polarized antenna payload for CubeSat," IEEE Antennas and Wireless Propagation Letters, vol. 16, pp. 2987-2991, 2017 provided a circularly polarized patch antenna applied to CubeSat, which can obtain an angular coverage of ±30°, a marginal gain of 6 dBic, an axial gain of 3.5 dBi, and an axial ratio of less than 3 dBic in the coverage. Although the antenna in this scheme has high gain, it is large in size, heavy in weight, and high in profile, which makes it difficult to be applied to CubeSat.

X. Ren, S. Liao, and Q. Xue, "A Circularly Polarized Spaceborne Antenna with Shaped Beam for Earth Coverage Applications," IEEE Transactions on Antennas and Propagation, vol. 67, no. 4, pp. 2235-2242, 2019 further provides a patch antenna loaded with dielectric. The dielectric lens plays the role of beamforming, thereby obtaining an isoflux pattern, achieving an angular coverage of ±50°, and a marginal gain of 3.45 dBic, which is greater than −5 dBic. The axial gain is less than 3 dB in the coverage area. Although the antenna in this scheme has a large coverage angle, the loaded dielectric block is bulky, heavy-weight, and high-profile, making it still difficult to be applied to CubeSats.

SUMMARY OF THE DISCLOSURE

The purpose of the disclosure is to provide a low-profile circularly polarized isoflux antenna module to solve the above-mentioned problems in the conventional technology.

The low-profile circularly polarized isoflux antenna module of the disclosure includes an antenna array, a substrate, a connection plate, and a feeding plate which are stacked in sequence. The feeding network on the feeding plate is electrically connected to the antenna array through a probe passing through the connection plate and the substrate. The antenna array includes two or more concentrically distributed antenna elements, and each antenna element forms mutually independent concentric circularly polarized apertures through feed control.

The antenna element in the innermost circle is a circular patch antenna. The center of the element is provided with a short-circuit pillar connected to the connection plate, and several feeding points are arranged around the short-circuit pillar and other arcs to connect to the feeding network. The antenna element in the innermost circle can also be an annular patch antenna or a spiral patch antenna.

The antenna element outside the innermost circle is an annular patch antenna or a spiral patch antenna or several antennas that rotate around the center of the element and are distributed in equal arcs.

The antennas that rotate around the center of the element and are distributed in equal arcs are planar inverted-F antennas.

The feeding point of the planar inverted-F antenna is at the geometric center of the planar inverted-F antenna.

The planar inverted-F antenna rotates around its own feeding point to adjust the circularly polarized aperture of the antenna element where it is located.

The antenna array includes two circles of antenna elements, the circularly polarized aperture of the inner circle of antenna element is located on the edge of the antenna element where it is located, and the circularly polarized aperture of the outer circle of the antenna element is located at a loop connection of each feeding point of the antenna element where it is located.

The low-profile circularly polarized isoflux antenna module of the disclosure has the advantage of realizing good circularly polarized isoflux radiation performance. The structure is simple to assemble and easy to process, light in weight, small in size, and low in profile. Specifically, when only two circles of antenna elements are provided, they are particularly suitable for integration on the surface of the CubeSat.

DESCRIPTION OF EMBODIMENTS

Figure 1:
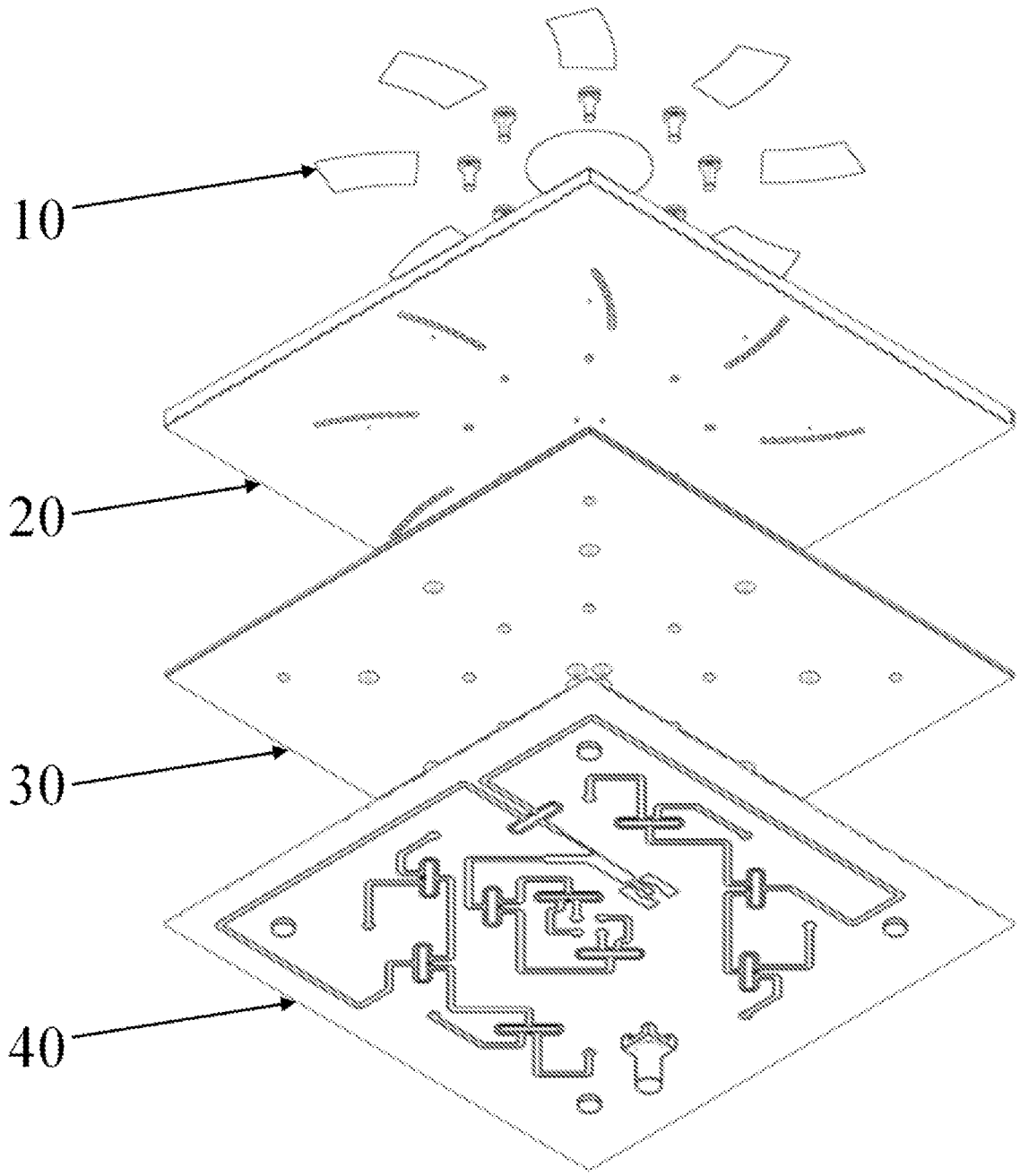
FIG. 1 is a schematic view of the structure of the antenna module of the disclosure.
Figure 2:
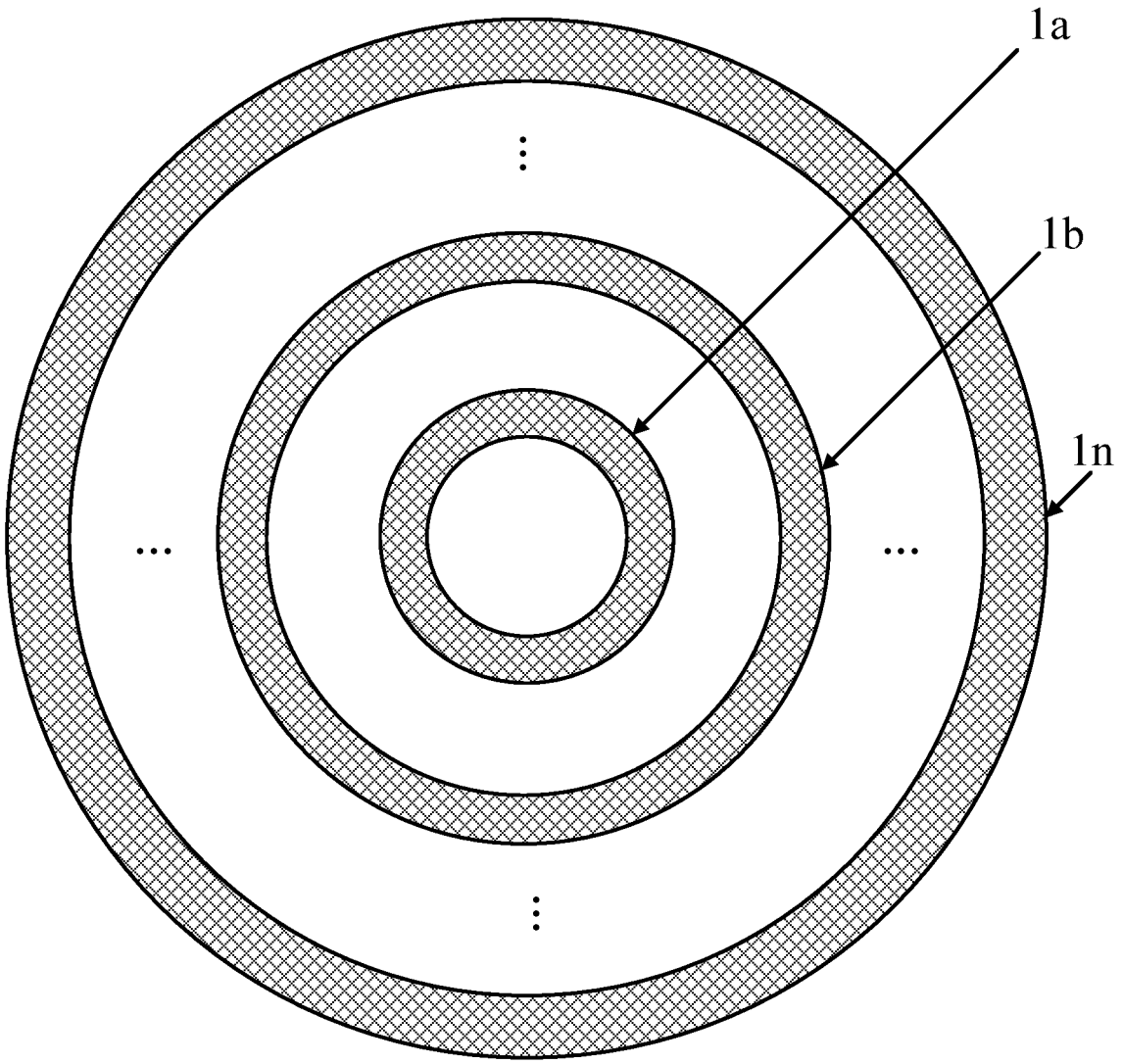
FIG. 2 is a schematic view of the circularly polarized aperture structure of the antenna module of the disclosure.

As shown in FIG. 1, the low-profile circularly polarized isoflux antenna module of the disclosure includes an antenna array 10, a substrate 20, a connection plate 30, and a feeding plate 40 which are stacked in sequence. The feeding network on the feeding plate 40 is electrically connected to the antenna array 10 through the probe passing through the connection plate 30 and the substrate 20. As shown in FIG. 2, the antenna array 10 includes two or more concentrically distributed antenna elements, and each antenna element forms mutually independent concentric circularly polarized apertures through feed control. In this manner, good circularly polarized isoflux radiation performance can be achieved. The structure is simple to assemble, easy to process, light in weight, small in size, and low in profile. The connection plate 30 may be an aluminum plate, which is used to reinforce the antenna and arrange probes connecting the upper and lower layers.

In order to be more suitable for application on CubeSat, this embodiment takes the design of the two circles of antenna element as an example for description, and performs simulation and physical testing on it.

Figure 3:
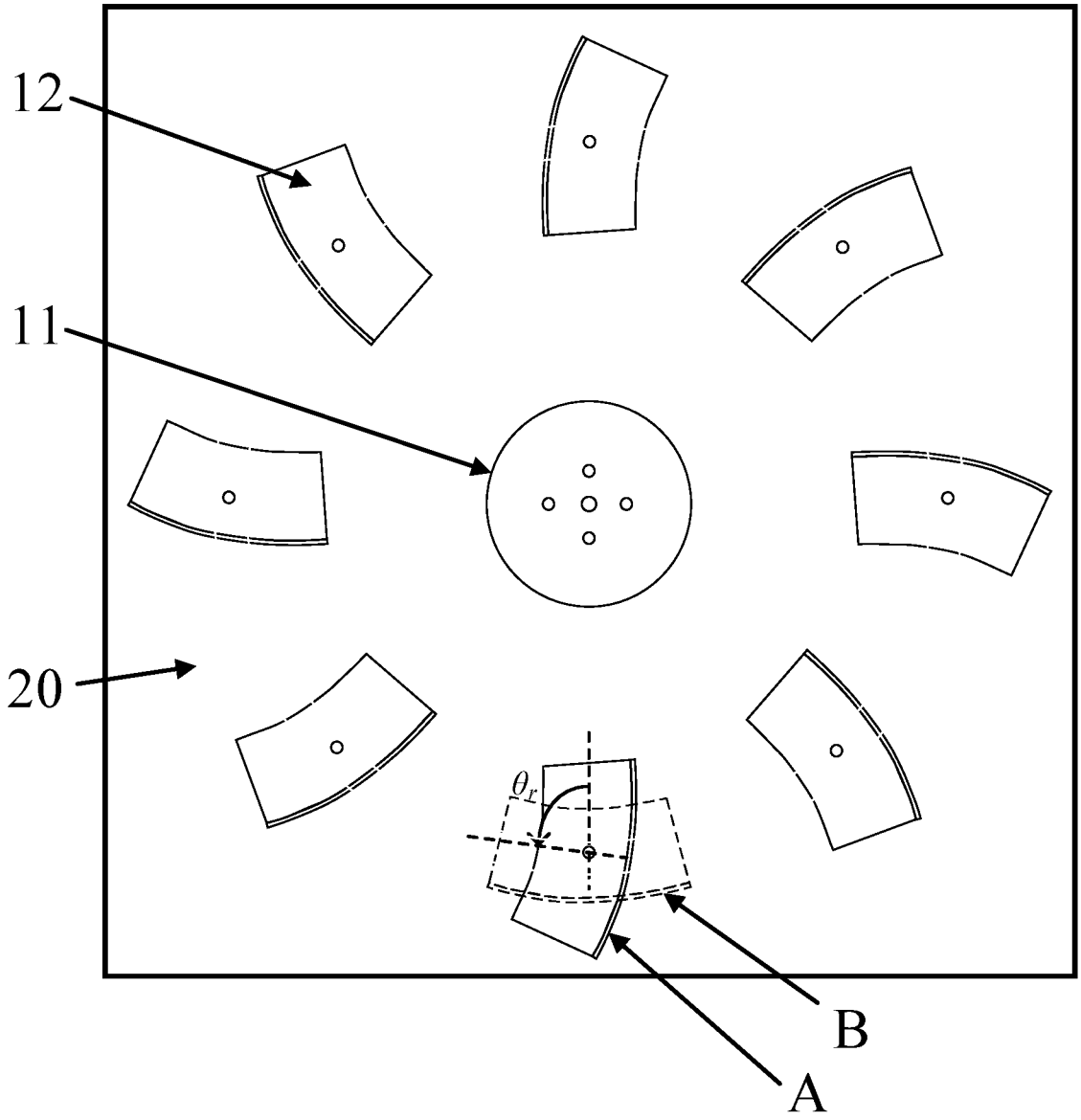
FIG. 3 is a schematic view of a specific antenna array distribution of the antenna module of the disclosure applied to the CubeSat.
Figure 4:
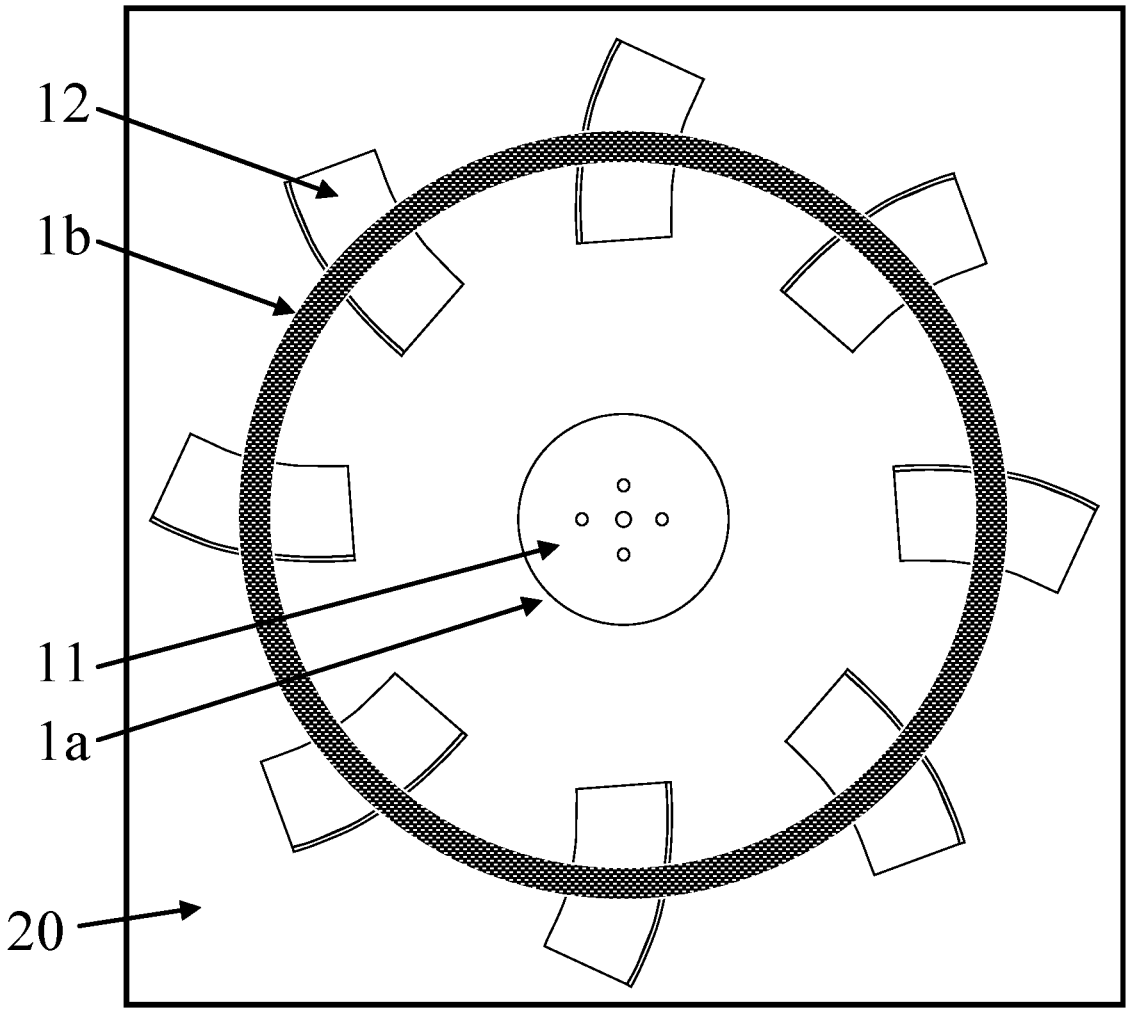
FIG. 4 is a schematic view of the circularly polarized aperture structure corresponding to the antenna array shown in FIG. 3.
Figure 5:
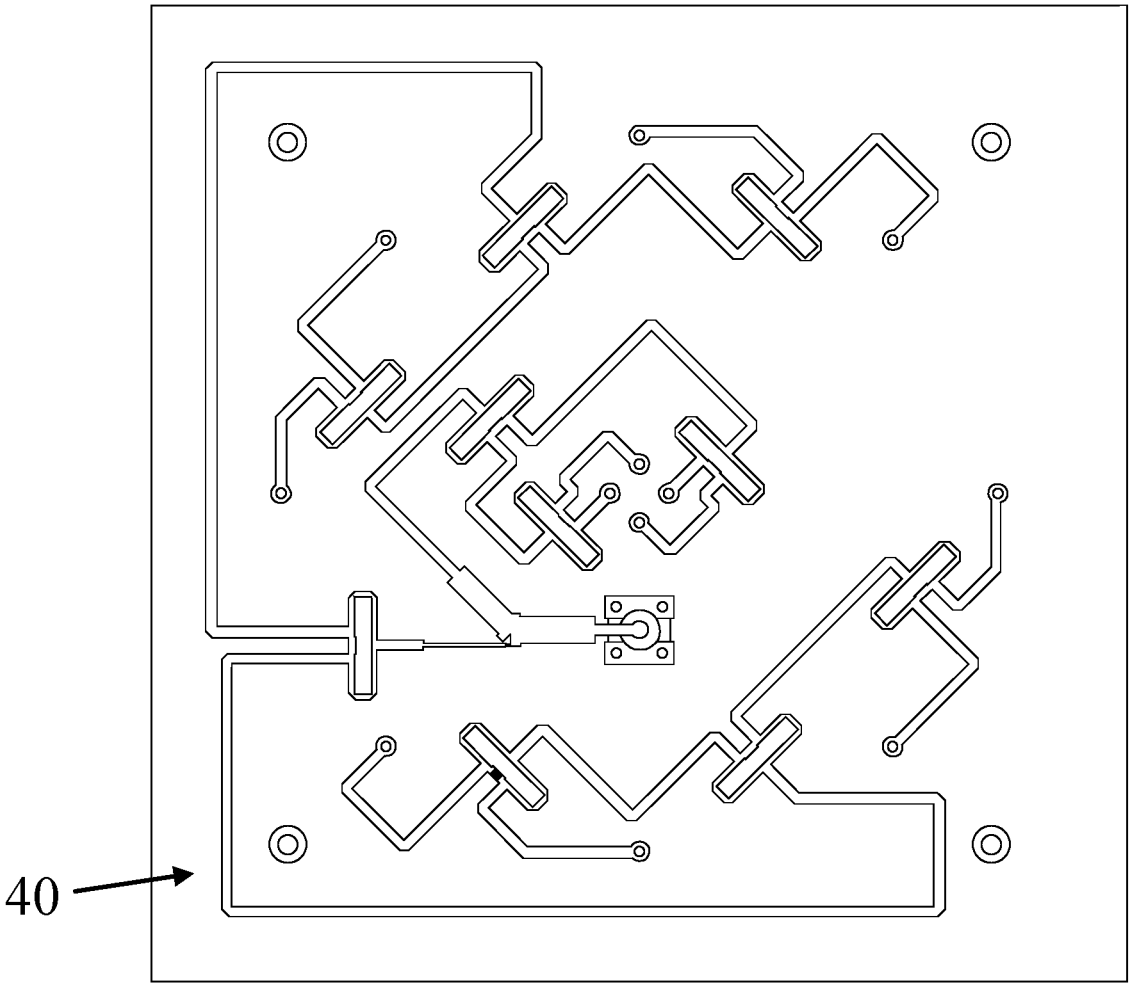
FIG. 5 is a schematic view of the structure of the feeding network corresponding to the antenna array shown in FIG. 3.
Figure 6:
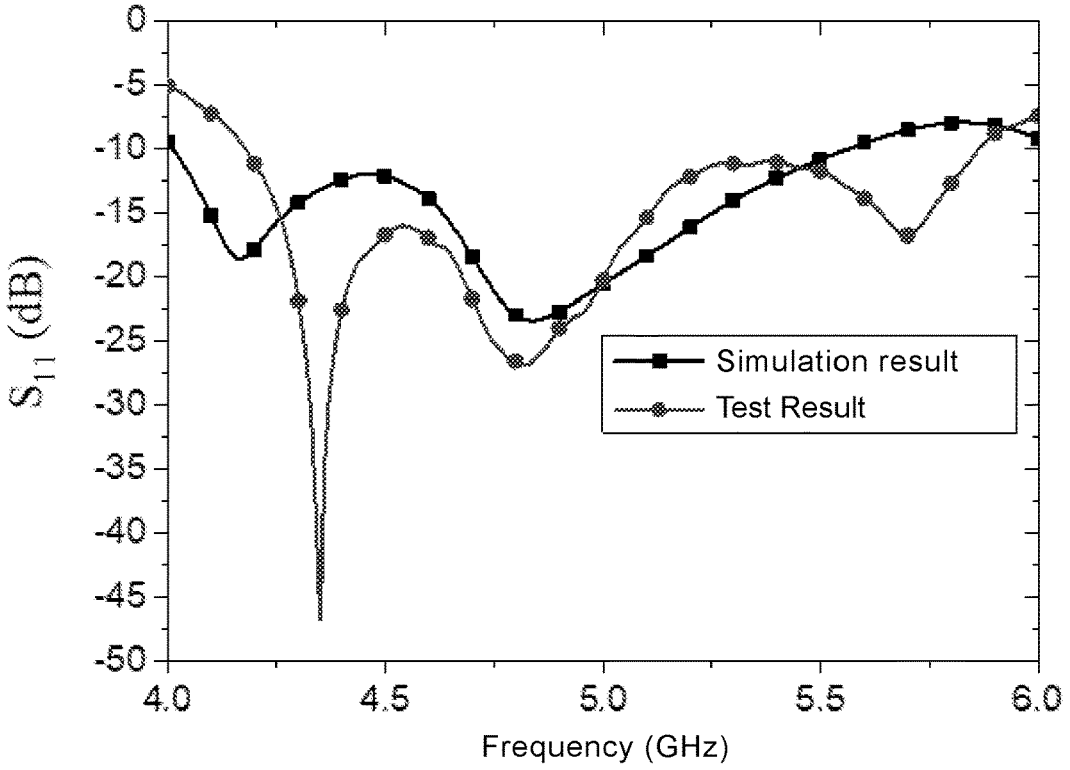
FIG. 6 is the S11 simulation and test data curve corresponding to the antenna array shown in FIG. 3.

As shown in FIG. 3 to FIG. 5, the antenna element in the inner circle is a circular patch antenna 11 or an annular patch antenna or a spiral patch antenna. In this embodiment, the circular patch antenna 11 is taken as an example to illustrate the technical solution. The center of the element is provided with a short-circuit pillar connected to the connection plate 30, and several feeding points are arranged around the short-circuit pillar and other arcs to connect to the feeding network, for example, 4 feeding points are provided.

The antenna element at the outer circle is an annular patch antenna or a spiral patch antenna or several antennas that rotate around the center of the element and are distributed in equal arcs. In this embodiment, several antennas that rotate around the center of the element and are distributed in equal arcs are taken as an example for description, and the antenna is exemplified as a planar inverted-F antenna 12, that is, PIFA. The feeding point of the planar inverted-F antenna 12 is at the geometric center of the planar inverted-F antenna 12.

The antenna element in each circle can be applicable to any existing antenna structures that can produce a circular radiation aperture.

The planar inverted-F antenna 12 rotates around its own feeding point to adjust the circularly polarized aperture of the antenna element where it is located. As shown in FIG. 3, a reasonable rotation is performed between position A and position B, and fixation is performed after selecting a suitable angle θr.

The feed adjustment is carried out through the feeding network in the feeding plate 40, so that the circularly polarized aperture of the antenna element in the inner circle is located on the edge of the antenna element where it is located, and the circularly polarized aperture of the antenna element at the outer circle is located on the loop connection of each feeding point on the antenna element where it is located.

Conventional antenna arrays use the same elements to form an array according to one-dimensional, two-dimensional or three-dimensional spatial arrangement, and use the principle of pattern product to calculate the overall pattern of the array. However, the antenna array provided by the disclosure is composed of different types of elements that all have circular radiating apertures. Due to the rotationally symmetrical structure, a rotationally symmetrical pattern in space can be naturally obtained, as shown in FIG. 2. Based on different forms of elements, therefore a more general principle of pattern superposition should be used to calculate the overall pattern of the array, that is, the total pattern is obtained by superimposing the unit pattern generated when each element is individually excited. For this general circularly polarized aperture array, the variables that can be optimized include structural parameters, such as the aperture size and relative position of each circularly polarized aperture element; and excitation parameters, such as the excitation amplitude, phase, etc. of each circularly polarized aperture element.

In order to ensure good circular polarization performance, the antenna array adopts a sequential feeding method for feeding. The inner circle of circular patch antenna uses four feeding points for feeding, and each feeding point has a phase difference of 90° to meet the circular polarization condition. The outer circle of elements are rotated and arranged by eight PIFAs and fed separately, and the phase difference of each feeding point is 45° to meet the circular polarization condition. First, one signal is divided into two signals by using a T-type power divider, and each signal is then cascaded by using Wilkinson power dividers to achieve a specific excitation amplitude and phase. The structure is shown in FIG. 5.

The inner circle of patch antenna is connected to the short-circuit pillar at the center, and the radius of the short-circuit pillar and the patch antenna is adjusted simultaneously, then the aperture field of the patch antenna can be changed without affecting the resonant frequency, that is, the aperture field of the inner circle of element can be adjusted. The outer circle of element can be adjusted directly from the center to change the aperture field of the outer circle of element. The PIFA of the outer circle can also be rotated along their respective feeding points to adjust the direction of the surface current and realize the adjustment of the polarization of the outer circle of elements. Under the circumstances, the aperture field of the inner circle of element, the aperture field and the polarization of the outer circle of element have been adjusted, combined with the adjustment of the excitation amplitude and phase of the inner and outer circles of elements, the beam forming of the entire array can be realized.

For the robustness of the overall structure, a 1 mm thick aluminum plate is mounted between the antenna array and the feeding network. In combination, the required new circularly polarized low-profile isoflux pattern antenna is obtained.

Figure 7:
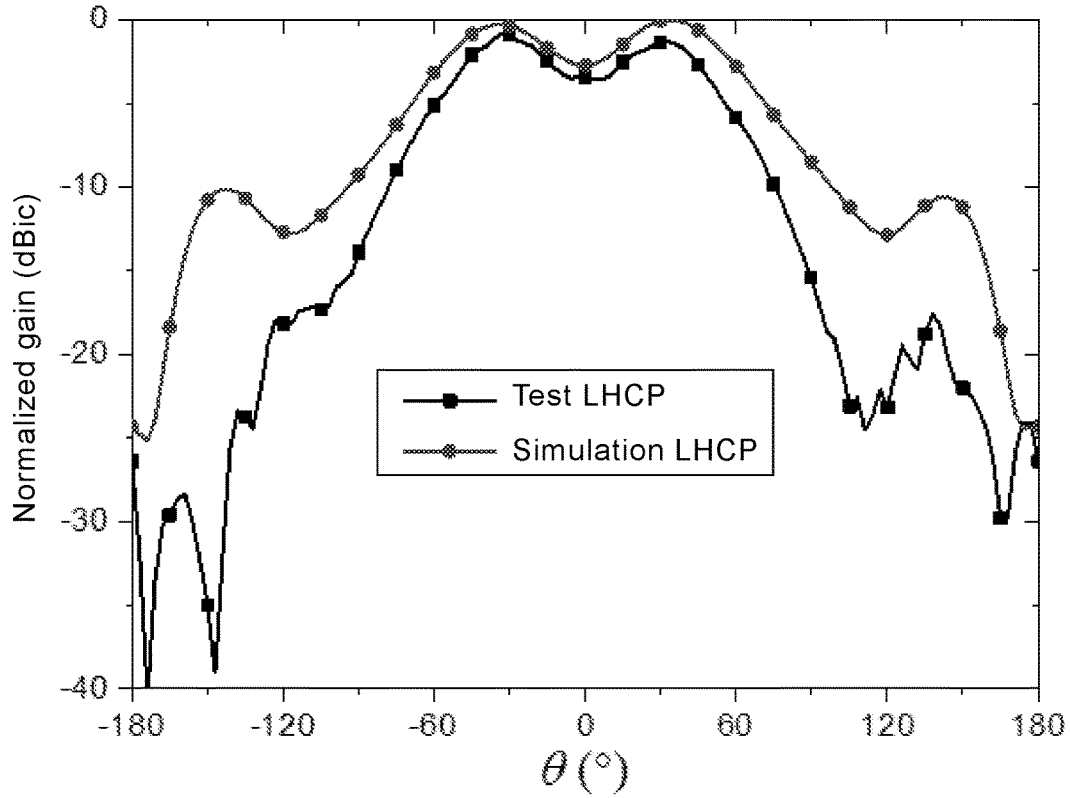
FIG. 7 is the left-hand circularly polarized gain simulation and test data curve corresponding to the antenna array shown in FIG. 3.
Figure 8:
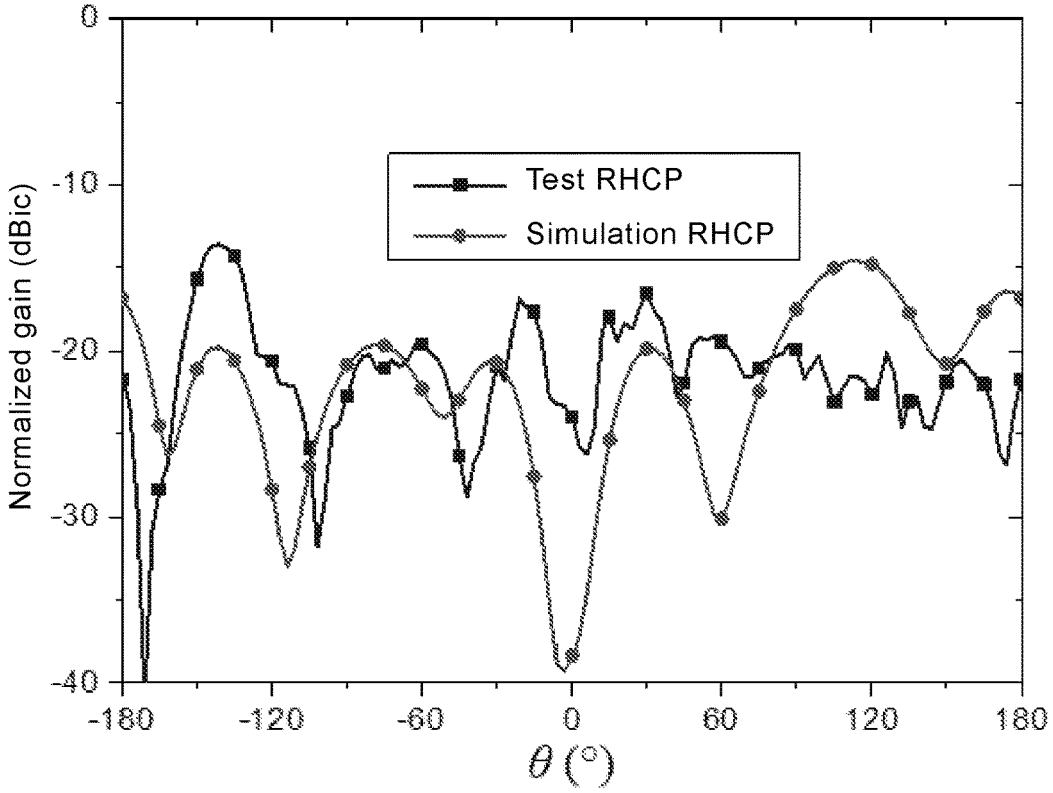
FIG. 8 is a right-hand circularly polarized gain simulation and test data curve corresponding to the antenna array shown in FIG. 3.
Figure 9:
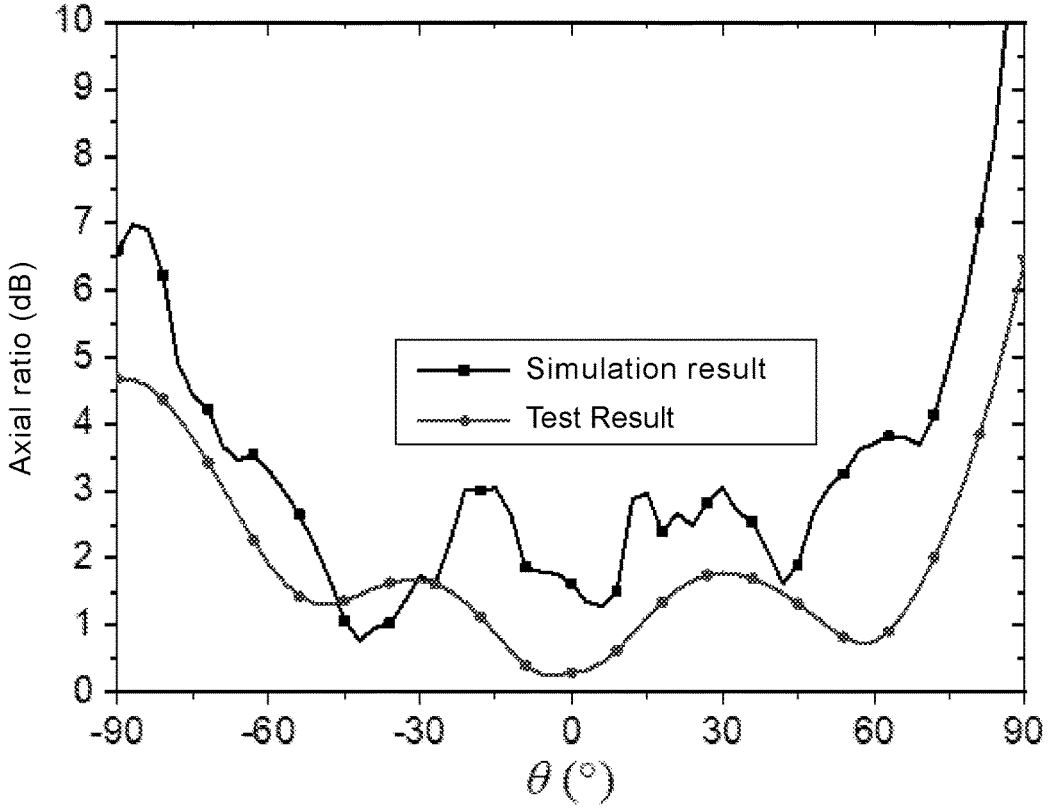
FIG. 9 is a curve of axial ratio simulation and test data corresponding to the antenna array shown in FIG. 3.

In this embodiment, the substrate used for the antenna array is Rogers RT/duroid 5870, the dielectric constant is 2.33, the loss tangent is 0.0012, and the thickness is 3.18 mm. The feeding network is designed on the Rogers RO4350B substrate, with a dielectric constant of 3.66, a loss tangent of 0.004, and a thickness of 0.508 mm. Physical and simulation data tests are performed as shown in FIG. 6 to FIG. 9, there are good matching performance and radiation performance in the operation frequency band. It can be seen from FIG. 6 that the simulated −10 dB impedance bandwidth of the antenna array is 4 GHz to 5.6 GHz, and the tested −10 dB impedance bandwidth is 4.2 GHz to 5.9 GHz. The simulation test results of the impedance bandwidth have good consistency. In FIG. 7, the simulated marginal gain of the antenna array at the 5 GHz frequency point is 4.38 dBic, the measured marginal gain is 3.48 dBic, the axial gain is 0.87 dBic, and the gain decreases by less than 1 dB. The decrease mainly results from processing errors, dielectric loss, etc., which are in the acceptable range. It can be seen from FIG. 8 and FIG. 9 that although the spatial axis ratio obtained from the test in the coverage area has changed compared with the simulation result, it is still less than 3 dB, which completely satisfies the technical indicators. The simulated 3 dB spatial axis ratio angle is −65° to 80°, and the tested 3 dB spatial axis ratio angle is −55° to 55°, which fully covers the required angle range of ±35°. In addition, the cross-section of the entire antenna structure is 4.688 mm, which is equivalent to 0.078 free-space wavelengths, which is only 1/7 of the existing antenna. The antenna structure of the disclosure is light in weight and can be easily integrated on CubeSat.

For those skilled in the art, various other corresponding changes and modifications can be made based on the technical solutions and concepts described above, and all these changes and modifications should fall within the scope to be protected by the claims of the disclosure.

What is claimed is:

1. A low-profile circularly polarized isoflux antenna module, comprising an antenna array, a substrate, a connection plate, and a feeding plate which are stacked in sequence, wherein a feeding network on the feeding plate is electrically connected to the antenna array through a probe passing through the connection plate and the substrate, the antenna array comprises two or more concentrically distributed antenna elements, and the antenna elements respectively form mutually independent concentric circularly polarized apertures through feed control;

an antenna element of the antenna elements in an innermost circle is a circular patch antenna, a center of the antenna element is provided with a short-circuit pillar connected to the connection plate, and several feeding points are arranged around the short-circuit pillar in equal arcs and connect to the feeding network.

2. The low-profile circularly polarized isoflux antenna module according to claim 1, wherein an antenna element of the antenna elements outside the innermost circle is an annular patch antenna or a spiral patch antenna or several antennas that rotate around the center of the antenna element and are distributed in equal arcs.

3. The low-profile circularly polarized isoflux antenna module according to claim 2, wherein the antennas that rotate around the center of the antenna element and are distributed in equal arcs are planar inverted-F antennas.

4. The low-profile circularly polarized isoflux antenna module according to claim 3, wherein a feeding point of each of the planar inverted-F antennas is at a geometric center of the planar inverted-F antenna.

5. The low-profile circularly polarized isoflux antenna module according to claim 4, wherein the planar inverted-F antenna rotates around the feeding point to adjust the circularly polarized aperture of the antenna element where it is located.

6. The low-profile circularly polarized isoflux antenna module according to claim 5, wherein the circularly polarized aperture of the antenna element in the innermost circle is located on an edge of the antenna element where it is located, and the circularly polarized aperture of the antenna element in an outer circle is located at a loop connection of the feeding points of the antenna element where it is located.

* * * * *